US009115036B1

(12) United States Patent
Maslo et al.

(10) Patent No.: US 9,115,036 B1
(45) Date of Patent: Aug. 25, 2015

(54) PROCESS FOR THE THERMAL TREATMENT OF AMMONIUM NITRATE FOR MANUFACTURING ANFO AND HEAVY ANFO

(71) Applicant: EXSA S.A., Lima (PE)

(72) Inventors: Karl Maslo, Lima (PE); Heberth Ruiz, Lima (PE)

(73) Assignee: EXSA S.A., Lima (PE)

( * ) Notice: Subject to any disclaimer, the term of this patent is extended or adjusted under 35 U.S.C. 154(b) by 0 days.

(21) Appl. No.: 14/448,000

(22) Filed: Jul. 31, 2014

(51) Int. Cl.

| | |
|---|---|
| ***C06B 45/00*** | (2006.01) |
| ***C06B 31/00*** | (2006.01) |
| ***C06B 31/28*** | (2006.01) |
| ***D03D 23/00*** | (2006.01) |
| ***D03D 43/00*** | (2006.01) |

(52) U.S. Cl.
CPC ..... *C06B 45/00* (2013.01); *C06B 31/00* (2013.01); *C06B 31/28* (2013.01); *D03D 23/00* (2013.01); *D03D 43/00* (2013.01)

(58) Field of Classification Search
USPC ..... 149/2, 45, 46, 109.4, 109.6
See application file for complete search history.

(56) References Cited

U.S. PATENT DOCUMENTS 5,240,524 A * 8/1993 Chattopadhyay ..... 149/46

* cited by examiner

*Primary Examiner* — James McDonough
(74) *Attorney, Agent, or Firm* — Jones Day

(57) ABSTRACT

A method of thermally treating high density ammonium nitrate for manufacturing ANFO and heavy ANFO including loading high density ammonium nitrate into a tank; entering the high density ammonium nitrate into heating equipment at room temperature; heating the high density ammonium nitrate inside the heating equipment; removing the treated ammonium nitrate from the heating equipment at a temperature less than 60° C.; and sieving the treated ammonium nitrate, thereby obtaining thermally treated ammonium nitrate; feeding thermally treated ammonium nitrate at a temperature of less than 30° C. into a mixing chamber while injecting fuel into the thermally treated ammonium nitrate feeding pipe, thereby obtaining ANFO; loading gassed or ungassed bulk emulsion into a hopper; feeding the bulk emulsion into the same mixing chamber as the ANFO; and mixing the bulk emulsion and the ANFO, thereby obtaining heavy ANFO.

14 Claims, 2 Drawing Sheets

PROCESS FOR THE THERMAL TREATMENT OF AMMONIUM NITRATE FOR MANUFACTURING ANFO AND HEAVY ANFO

BACKGROUND OF THE INVENTION

1. Field of the Invention

The present invention is related to explosive compositions such as ammonium nitrate/fuel oil (ANFO) and heavy ANFO type explosives, and in particular to a thermal treatment to create pores by modifying the crystalline structure of high density ammonium nitrate in order to manufacture ANFO and heavy ANFO.

2. Description of the Related Art

Ammonium nitrate/fuel oil (ANFO) type explosives are a mixture of ammonium nitrate and fuel oil, which are used as a blasting compound in mining and industrial engineering. Typically, ANFO type explosives are composed of 94% ammonium nitrate and 6% fuel oil, and have a density of 0.8-0.9 kg/L. The ammonium nitrate particles used for ANFO type explosives are porous and spherical in shape because their microporous structure of air cavities enclosed within the body of the prills provide a larger number of points of initiation with increased detonation sensitivity, or hotspots, which are closed adiabatically as a result of mechanical action and spread the burning process throughout the charge. The fuel oil is absorbed by the ammonium nitrate particles to produce a free-flowing particulate mixture which can be detonated. Other additives may be added to this mixture in order to modify the properties of the ANFO explosive, such as adding guar gums and polyisobutylene to improve water resistance.

Detonation velocity of ANFO explosives falls within the range 2500-3500 m/s because of its volumetric density and flame temperature, which are lower than that of other industrial explosives. The sensitivity of these materials to detonation is also lower than that of emulsion and dynamite type explosives; thus, the handling of ANFO type explosives is easier. The performance of ANFO depends on the ammonium nitrate prills used and the efficiency of mixing the prills with the fuel oil.

Heavy ANFO type explosives comprise a mixture of bulk emulsion and ammonium nitrate/fuel oil (ANFO). The use of emulsion type explosives as a coating substance creates a waterproof-resistant barrier, surrounding the particles of ANFO and solving the problem of its low water resistance. This waterproof-resistant barrier also improves other characteristics of ANFO by increasing its density, detonation velocity, sensitivity to initiation and shock wave intensity. Heavy ANFO is typically prepared in a bulk truck by making ANFO first, and then blending it with emulsion. Bulk emulsion used in the preparation of heavy ANFO may be gassed or not gassed. The system of heavy ANFO allows for a great deal of flexibility in the relative proportions of ANFO/bulk emulsion. This ratio can be optimized depending on the blast site-specific requirements.

As mentioned, ANFO and heavy ANFO type explosives typically need porous ammonium nitrate prills. Previous attempts to use high density ammonium nitrate in ANFO and heavy ANFO manufacturing include U.S. Pat. No. 5,240,524. This invention provides a method for modifying ammonium nitrate's density that comprises mixing it with a liquid medium, such as water, nitric acid or sodium nitrite, which penetrate the ammonium nitrate particles via pre-existing pathways, dissolving ammonium nitrate and producing a gassing reaction. As a result, the method obtains particles of higher porosity. However, the present invention differs from the aforementioned patent in the method used to create those pores.

The present invention provides a method to prepare ANFO and heavy ANFO type explosives by using high density ammonium nitrate, preferably fertilizer or technical grade, in which the crystalline structure is modified by a thermal treatment process, as a substitute for porous ammonium nitrate.

Information about the Assignee

EXSA was incorporated in 1954. The company's plant, offices and main warehouses are located in Lima, Peru. In addition, the company has various business offices, other industrial plants, powder magazines, and warehouses throughout the Peruvian territory.

EXSA engages in the manufacture, transformation, industrial operation, representation, development, research, marketing, distribution, transportation, import and export of explosives, as well as their components, accessories, associated products and by-products. Likewise, EXSA may provide any services associated with the aforementioned activities, including specialized support works for mining prospecting, development and operation, and ore reduction.

SUMMARY OF THE INVENTION

An object of the present invention includes a method of thermally treating high density ammonium nitrate including loading high density ammonium nitrate into a tank; entering the high density ammonium nitrate into heating equipment at room temperature; heating the high density ammonium nitrate inside the heating equipment; removing the treated ammonium nitrate from the heating equipment at a temperature less than 60° C.; and sieving the treated ammonium nitrate, thereby obtaining thermally treated ammonium nitrate.

Another object of the present invention includes a method of preparing ANFO including loading thermally treated ammonium nitrate at a temperature of less than 30° C. into a tank; loading fuel into a separate tank; feeding the thermally treated ammonium nitrate into a mixing chamber while feeding the fuel into the same mixing chamber; and mixing the thermally treated ammonium nitrate and fuel, thereby obtaining ANFO.

Yet another object of the present invention includes a method of preparing heavy ANFO including loading thermally treated ammonium nitrate into a hopper; feeding the thermally treated ammonium nitrate into a mixing chamber while injecting fuel into the thermally treated ammonium nitrate feeding pipe, thereby obtaining ANFO; loading gassed or ungassed bulk emulsion into a hopper; feeding the bulk emulsion into the same mixing chamber as the ANFO; and mixing the bulk emulsion and the ANFO, thereby obtaining heavy ANFO.

DETAILED DESCRIPTION OF THE INVENTION

An embodiment of the present invention modifies the crystalline structure of high density ammonium nitrate, preferably fertilizer or technical grade, creating pores. As a consequence, the density of the ammonium nitrate is reduced, while retaining optimal crushing strength levels. A process for the thermal treatment of high density ammonium nitrate, preferably fertilizer or technical grade, is proposed. This embodiment is illustrated in FIG. 1.

Figure 1:
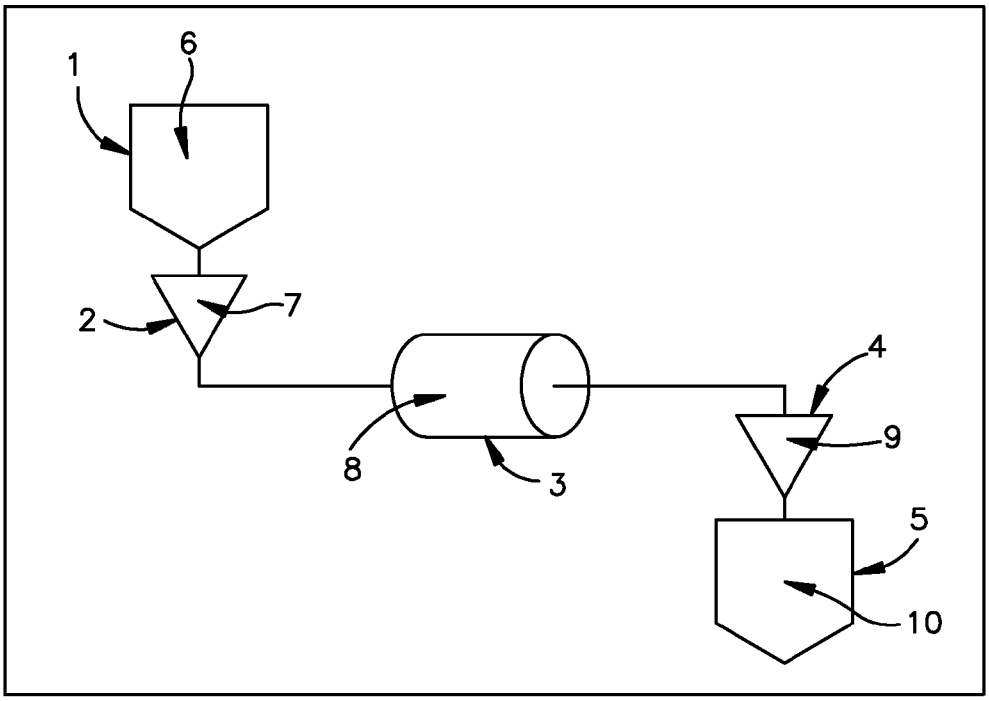
FIG. 1 shows the process and components related thereto used to thermally treat high density ammonium nitrate.

FIG. 1 shows an embodiment of the thermal treatment process for high density ammonium nitrate, preferably fertilizer or technical grade. The first step is loading high density ammonium nitrate 6, which typically includes the properties mentioned in Table 1 and Table 2, into a tank 1. Next, the ammonium nitrate is sieved 2 to separate fines. This is done in order to avoid a reduction in the thermal process efficiency. If high density ammonium nitrate has less than 5% of fines, then there is no need to sieve it.

TABLE 1

Differences between Technical Grade Ammonium Nitrate and Fertilizer Grade

| Parameter | Unit | High-density Technical Grade | Ammonium Nitrate Fertilizer Grade |
|---|---|---|---|
| $NH_4NO_3$ Purity | % | ≥98.5 | ≥97.5 |
| Insoluble | % | 0 | ≤2 |
| Calcium (CaO) | % | 0 | ≤2 |
| Magnesium (MgO) | % | 0 | ≤2 |
| Phosphorus ($P_2O_5$) | % | 0 | ≤3.5 |
| Potassium ($K_2O$) | % | 0 | ≤2 |

In the next step, high density ammonium nitrate 8 enters the heating equipment 3 at room temperature. The thermal treatment process comprises indirect heat transference from the heating equipment to the high density ammonium nitrate. During the thermal treatment process, the control variables are the temperature and treatment time of the ammonium nitrate in the heat treatment equipment, as well as the temperature of the ammonium nitrate upon the exit of the heat treatment equipment. These variables can affect the generation of pores and the hardness of the treated ammonium nitrate. The heating equipment's temperature may range from 50 to 150° C. The temperature of ammonium nitrate at the exit of heating equipment should not exceed 60° C., and preferably ranges from 40 to 60° C.; otherwise the crushing strength of ammonium nitrate can decrease considerably. High density ammonium nitrate treatment time is directly related to the desired exit temperature of treated ammonium nitrate. Typically, this treatment time is between 1 and 10 minutes.

Subsequently, further sieving 4 is performed to remove the fines that were generated in the previous stage. The product obtained is thermally treated ammonium nitrate 10, which typically shows the properties described in Table 2.

TABLE 2

Properties of High Density Ammonium Nitrate, Porous Ammonium Nitrate, and Treated Ammonium Nitrate.

| Parameter | Unit | High density Ammonium Nitrate (Fertilizer or Technical Grade) | Porous Ammonium Nitrate | Treated Ammonium Nitrate |
|---|---|---|---|---|
| Bulk Density | kg/L | 0.95-1.00 | 0.72-0.82 | 0.80-0.90 |
| Oil Absorbency | % | ≤4 | 7-14 | 5-8 |
| Crushing strength | kg | 0.4-0.6 | 0.35-0.55 | 0.2-0.5 |

The thermally treated ammonium nitrate can be used as a replacement for porous ammonium nitrate in manufacturing ANFO and heavy ANFO type explosives. For the preparation of ANFO, treated ammonium nitrate must have a temperature below 30° C., and preferably between room temperature and 30° C.

Figure 2:
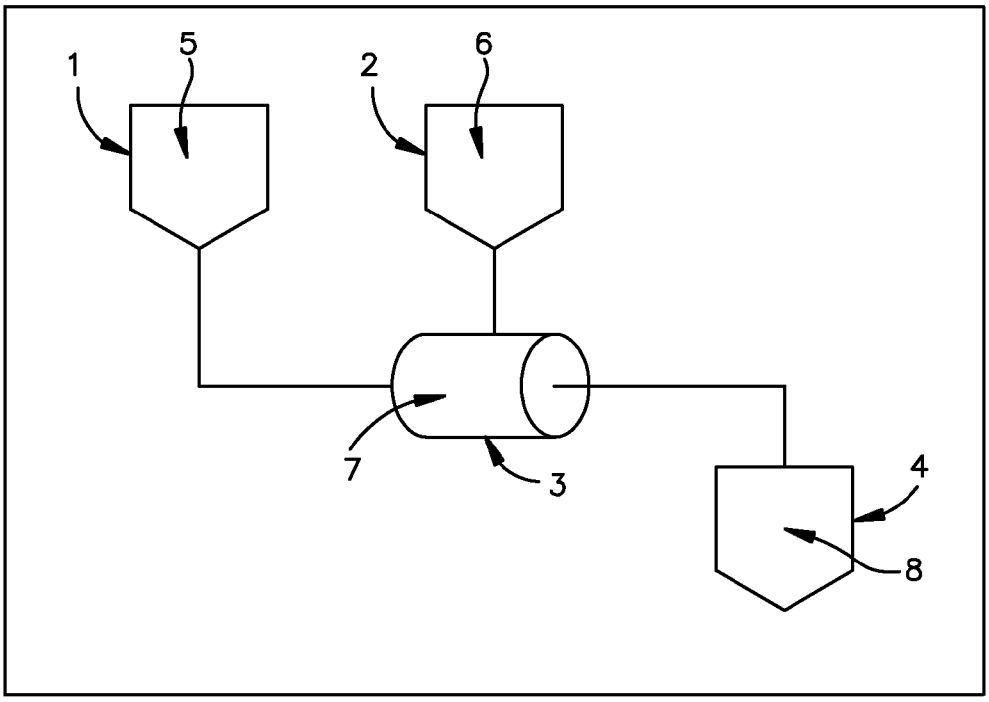
FIG. 2 shows the process and components related thereto used to manufacture ANFO.

The ANFO manufacturing process is performed according to the flow diagram illustrated in FIG. 2. The process includes mixing 3 thermally treated ammonium nitrate 6 and fuel 5 in ratios of 95:5 to 94:6, and preferably at a ratio of 94:6. The fuel 5 used in the ANFO manufacturing process can be a biofuel, biodiesel, diesel, mineral oil or residual oil, among others.

Figure 3:
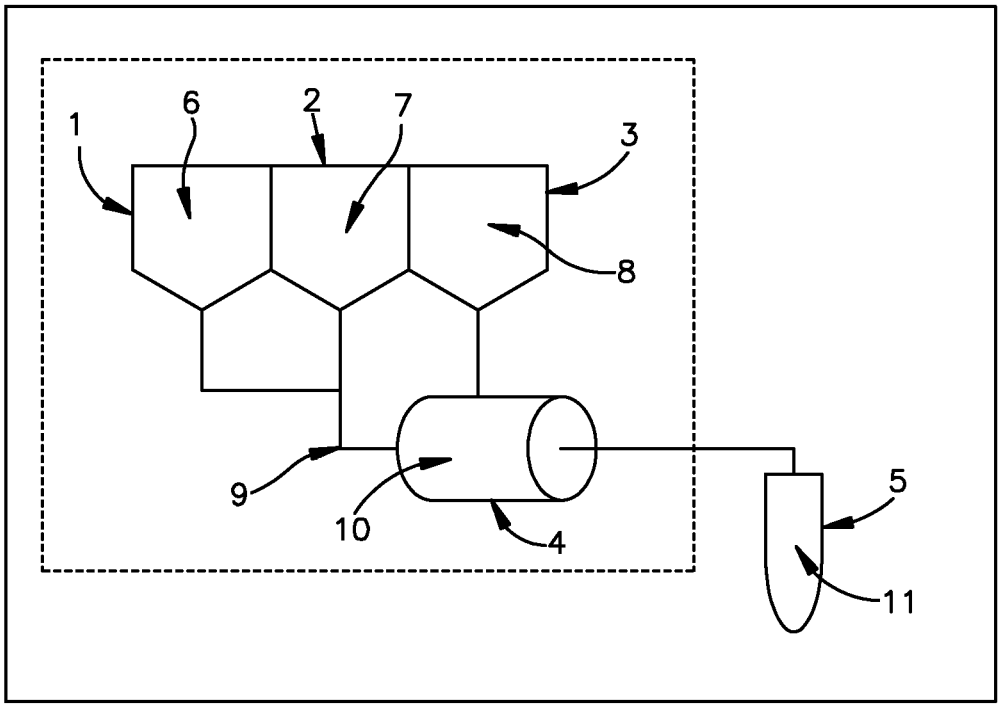
FIG. 3 shows the process and components related thereto used to manufacture heavy ANFO.

The manufacturing process of heavy ANFO is performed according to the flow diagram illustrated in FIG. 3. This process is preferably performed in bulk trucks at mining operations.

The first step of the process is loading thermally treated ammonium nitrate 7 into a hopper 2. Next, fuel 6 contained in a hopper 1 is injected to the treated ammonium nitrate feeding pipe, thereby obtaining ANFO 9. This mixture is prepared in ratios of 98:2 to 94:6, preferably at a ratio of 97:3. The fuel used in ANFO manufacturing process can be a biofuel, biodiesel, diesel, mineral oil or residual oil, among others.

Subsequently, bulk emulsion 8 contained in a hopper 3 is gassed, in order to be mixed with ANFO 10, thereby obtaining heavy ANFO 11. The mixing ratios of bulk emulsion 8 to ANFO 10 are preferably the following: 20:80, 30:70, 40:60, 50:50, 60:40 and 70:30. Bulk emulsion used for this preparation can be gassed or not gassed. The final product 11 is loaded to the boreholes 5 at mining operations.

We claim:

1. A method of thermally treating high density ammonium nitrate comprising:

loading high density ammonium nitrate into a tank;

entering the high density ammonium nitrate into heat treatment equipment, wherein the ammonium nitrate is at room temperature upon entrance;

heating the high density ammonium nitrate inside the heat treatment equipment;

removing the treated ammonium nitrate from the heat treatment equipment, wherein the exit temperature does not exceed 60° C.; and sieving the treated ammonium nitrate, thereby obtaining thermally treated ammonium nitrate, wherein the high density ammonium nitrate has a bulk density of 0.95-1.00 kilograms per liter (kg/L), a fuel absorption of less than or equal to 4%, and a crushing strength of about 0.2-0.6 kilogram (kg).

2. A method according to claim 1, wherein the high density ammonium nitrate may be fertilizer grade or technical grade.

3. A method according to claim 1, wherein high density ammonium nitrate is sieved before entering it into the heating equipment.

4. A method according to claim 1, wherein the heating equipment temperature is 50-150° C.

5. A method according to claim 1, wherein the treated ammonium nitrate exit temperature is 40-60° C.

6. A method according to claim 1, wherein the treatment time is 1-10 minutes.

7. A method of preparing ANFO comprising:

loading thermally treated ammonium nitrate from claim 1 into a tank, wherein the thermally treated ammonium nitrate temperature is below 30° C.;

loading fuel into a separate tank;

feeding the thermally treated ammonium nitrate into a mixing chamber while feeding the fuel into the same mixing chamber; and mixing the thermally treated ammonium nitrate and fuel, thereby obtaining ANFO, wherein the thermally treated ammonium nitrate has a bulk density of 0.95-1.00 kg/L, an oil absorbency of less than or equal to 4%, and a crushing strength of about 0.2-0.6 kg.

8. A method according to claim 7, wherein the fuel is a biofuel, biodiesel, diesel, mineral oil or residual oil.

9. A method according to claim 7, wherein the mixing ratio of the thermally treated ammonium nitrate to the fuel is from 95:5 to 94:6.

10. A method of preparing heavy ANFO comprising:

loading thermally treated ammonium nitrate from claim 1 into a hopper;

feeding the thermally treated ammonium nitrate into a mixing chamber while injecting fuel into the thermally treated ammonium nitrate feeding pipe, thereby obtaining ANFO;

loading bulk emulsion into a hopper; wherein the bulk emulsion may be gassed or not gassed;

feeding the bulk emulsion into the same mixing chamber as the ANFO; and mixing the bulk emulsion and the ANFO, thereby obtaining Heavy ANFO, wherein the thermally treated ammonium nitrate has a bulk density of 0.95-1.00 kg/L, an oil absorbency of less than or equal to 4%, and a crushing strength of about 0.2-0.6 kg.

11. A method according to claim 10, wherein the fuel is a biofuel, biodiesel, diesel, mineral oil or residual oil.

12. A method according to claim 10, wherein the fuel to treated ammonium nitrate mixing ratio is 2:98 to 6:94.

13. A method according to claim 10, wherein the bulk emulsion to ANFO mixing ratio is 20:80 to 70:30.

14. A method according to claim 10, wherein the bulk emulsion may be gassed prior to feeding it into the same mixing chamber as the ANFO.

* * * * *